US006767272B2

(12) United States Patent
Santarsiero

(10) Patent No.: US 6,767,272 B2
(45) Date of Patent: Jul. 27, 2004

(54) HOPPING MECHANISM FOR MODEL CAR

(75) Inventor: Paul S. Santarsiero, Avon, CT (US)

(73) Assignee: Craft House Corporation, Toledo, OH (US)

( * ) Notice: Subject to any disclaimer, the term of this patent is extended or adjusted under 35 U.S.C. 154(b) by 0 days.

(21) Appl. No.: 10/663,520

(22) Filed: Sep. 16, 2003

(65) Prior Publication Data

US 2004/0077281 A1 Apr. 22, 2004

Related U.S. Application Data

(60) Provisional application No. 60/412,864, filed on Sep. 23, 2002.

(51) Int. Cl.[7] ..... A63H 17/26

(52) U.S. Cl. ..... 446/466; 446/437; 446/469

(58) Field of Search ..... 446/437, 448, 446/457, 465, 466, 470, 469, 468

(56) References Cited

U.S. PATENT DOCUMENTS

| | | | | | |
|---|---|---|---|---|---|
| 1,619,726 | A | * | 3/1927 | Heyman | 446/437 |
| 3,121,294 | A | * | 2/1964 | Balthazor | 446/466 |
| 4,125,261 | A | | 11/1978 | Lahr | |
| 4,218,846 | A | | 8/1980 | Lahr | |
| 4,696,655 | A | | 9/1987 | D'Andrade et al. | |
| 5,527,059 | A | | 6/1996 | Lee, Jr. | |
| 5,643,041 | A | | 7/1997 | Mukaida | |
| 5,722,872 | A | | 3/1998 | Simmons et al. | |
| 5,762,533 | A | | 6/1998 | Tilbor et al. | |
| 6,015,330 | A | | 1/2000 | Simmons et al. | |
| 6,036,575 | A | * | 3/2000 | Rehkemper et al. | 446/466 |
| 6,383,054 | B1 | * | 5/2002 | Rauch | 446/456 |
| 6,394,877 | B1 | * | 5/2002 | Venditti | 446/466 |

* cited by examiner

*Primary Examiner*—Jacob K. Ackun
*Assistant Examiner*—Bena B. Miller
(74) *Attorney, Agent, or Firm*—MacMillan, Sobanski & Todd; Donald R. Fraser

(57) ABSTRACT

A model car having a mechanism, including an electric motor, for raising and lowering the chassis in respect of the ground engaging wheels.

11 Claims, 4 Drawing Sheets

HOPPING MECHANISM FOR MODEL CAR

CROSS REFERENCE TO RELATED APPLICATION

This application claims the benefit of U.S. Provisional Patent Application Serial No. 60/412,864 filed Sep. 23, 2002.

BACKGROUND OF THE INVENTION

1. Field of the Invention

The invention relates to model cars and more particularly to a model car which can be assembled from a kit requiring minimum skill and tools. Further, the body of the assembled model care may be selectively raised and lowered in respect of the ground engaging wheels.

2. Description of the Prior Art

The prior art is replete with model cars and other similar vehicle replicas having wheels which may be driven, typically by a D.C. electric motor, to propel the vehicle forward or backward. Such motion of a vehicle imparts great interest in the attending youth.

SUMMARY OF THE INVENTION

It is an objective of the invention to produce a model car which can be caused to raise or lower the body relative to the respective ground engaging wheels.

Another object of the invention is to produce a model car kit comprised of a number of individual components which may be readily assembled with a minimal number of tools by a person having minimal dexterity.

The above as well as other objectives of the invention may be typically achieved by a model car assembly including: a chassis; a first arm having outer and inner ends, the outer end receiving ground engaging means at the outer end thereof; a first pivotal mounting intermediate the outer and inner ends of the first set of arms for pivotally mounting the first set of arms to the chassis; a second arm having outer and inner ends, the outer end receiving ground engaging means and the inner end in sliding engagement with the inner end of the first arm; a second pivotal mounting intermediate the outer and inner ends of the second arm for pivotally mounting the second arm to the chassis; a drive motor; a cam member engaging the first arm between the outer end thereof and the first pivotal mounting arm; and a gear train coupled to the drive motor to drive the cam member to cause movement of the chassis upwardly and downwardly by causing pivotal movement of the first arm whereby the inner end of the first arm cams the inner end of the second arm upwardly causing an upward movement of the chassis.

BRIEF DESCRIPTION OF THE DRAWINGS

The above objects and advantages, as well as others, will become clearly apparent to one skilled in the art from reading the following detailed description of a preferred embodiment of the invention when considered in the light of the attached drawings, in which.

DETAILED DESCRIPTION OF THE PREFERRED EMBODIMENT OF THE INVENTION

Figure 1:
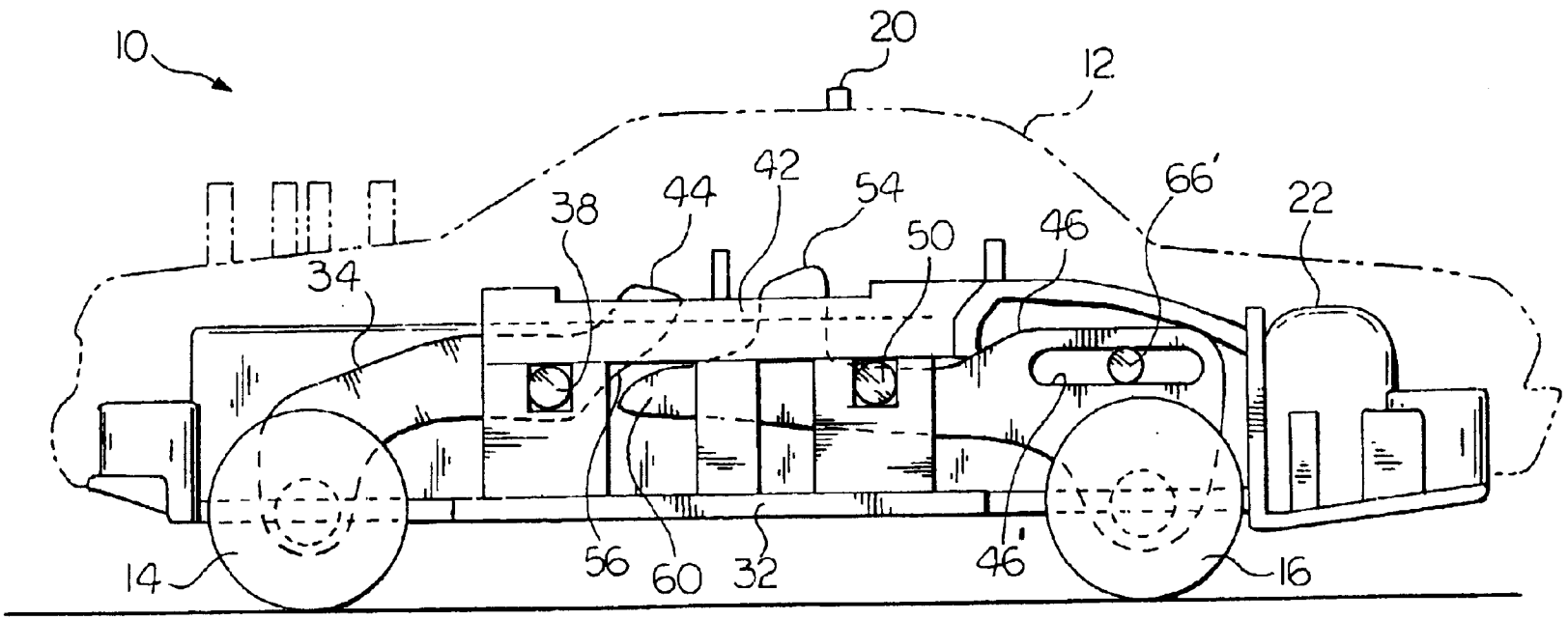
FIG. 1 is a side elevational view of a model car incorporating the features of the invention showing the chassis in the normal position with the body portion illustrated in phantom.

Referring to the drawings, there is illustrated a preferred embodiment of the invention in the form of a model car capable of raising or lowering the body of the car in respect of the associated front or rear wheel assemblies.

More specifically, there is shown in FIGS. 1, 2, 3, and 4, a model car, generally indicated by a reference numeral 10, including a body assembly 12; ground engaging front wheels 14, 14'; ground engaging rear wheels 16, 16'; and a power source 18, containing suitable batteries and having a switch 20, coupled to an electric motor 22 through a battery 24.

The body assembly 12 typically replicates the sheet metal, glass, and bumpers of a conventional commercially sold vehicle, such as a 1963 Chevrolet Impala (trademarks owned by General Motors Corporation, U.S.A.). The body assembly 12 also includes a chassis 32 formed to replicate the vehicle frame, suspension system, and certain other components of the running gear. The body 12 and the chassis 32 may typically be formed of a plastic material which may be formed to genuinely represent the commercial vehicle. The plastic components may be glued together and/or assembled by suitable threaded fasteners.

The actual suspension of the model car 10 is achieved though the use of a front axle arm assembly and a rear axle arm assembly, including spaced apart front wheels 14 and 14' and rear wheels 16 and 16'. The front wheels 14 and 14' are rotationally supported or mounted on axles affixed to the outer ends of respective arms 34 and 36. The arms 34 and 36 are pivotally mounted by pivotal mountings 38 and 40 on opposite sides of a central chassis frame member 42. The pivotal mountings 38 and 40 are disposed intermediate the outer ends and the inner ends thereof. The inner ends of the arms 34 and 36 are typically connected together by a cross member 44.

The rear wheels 16 and 16' are rotationally supported or mounted on axles affixed to the outer ends of respective arms 46 and 48. The arms 46 and 48 are pivotally connected to opposite sides of the central chassis frame 42 and spaced from the respective pivotal mountings 38 and 40 of the arms 34 and 36. Pivotal mountings 50 and 52 are disposed intermediate the outer end and the inner end of the respective arms 46 and 48. In a manner similar to the interconnection of the inner ends of the arms 34 and 36, the inner ends of the arms 46 and 48 thereof are integrally connected together by a cross member 54.

It will be noted that the arms 34 and 36 are provided inner end portions 56 and 58, respectively, which contain lower cam surfaces which tend to curve upwardly. Also, the arms 46 and 48 are provided with inner end portions 60 and 62, respectively which contain upper cam surfaces adapted to contact and cam the associated cam surfaces of the respective inner end portions 56 and 58 of the arms 34 and 36.

It will be noted that in the normal position, the cross members 44 and 54 rest on the upper portion of the central chassis frame 42 and the weight of the chassis and ancillary components is carried thereby.

The electric motor 22 is suitably mounted in and secured to the chassis 32. The battery 24 and associated switch 20 provide power for energization of the motor 22.

The motor 22 is provided with an output shaft having an output gear 64 secured thereto. The output gear 64 serves as the power input gear of a gear train which is capable of selectively delivering power to oppositely disposed cam wheels 66, 68. The cam wheels 66 and 68 are effective to drive the rear axle arm assemblies which will be explained in detail hereafter.

The gear train includes the output gear 64 attached to the armature of the motor 22. The teeth of the gear 64 are caused to mesh with the teeth of a gear 70 which, in turn, is keyed to a gear 72. The teeth of the gear 72 are caused to mesh with the teeth of a gear 74 which is keyed or otherwise affixed to rotate with an axle shaft 76. The cam wheels 66 and 68 are affixed to and carried by the axle shaft 76 in spaced relation to one another.

The cam wheel 66 is provided with an outwardly projecting cam arm 66', while the cam wheel 68 is provided with an outwardly projecting cam arm 68'. The cam arms 66' and 68' are effective to cause movement of the rear axle arms 34 and 36. Each of the arms 46 and 48 is provided with an elongate slot 46' and 48', respectively. The slots 46' and 48' are adapted to receive the cam arms 66' and 68', respectively. It will be appreciated that any circular movement of the cam arms 66' and 68' will be converted to angular vertical pivotal movement of the respective arms 46 and 48 about the respective pivotal mounting 50 and 52.

Figure 2:
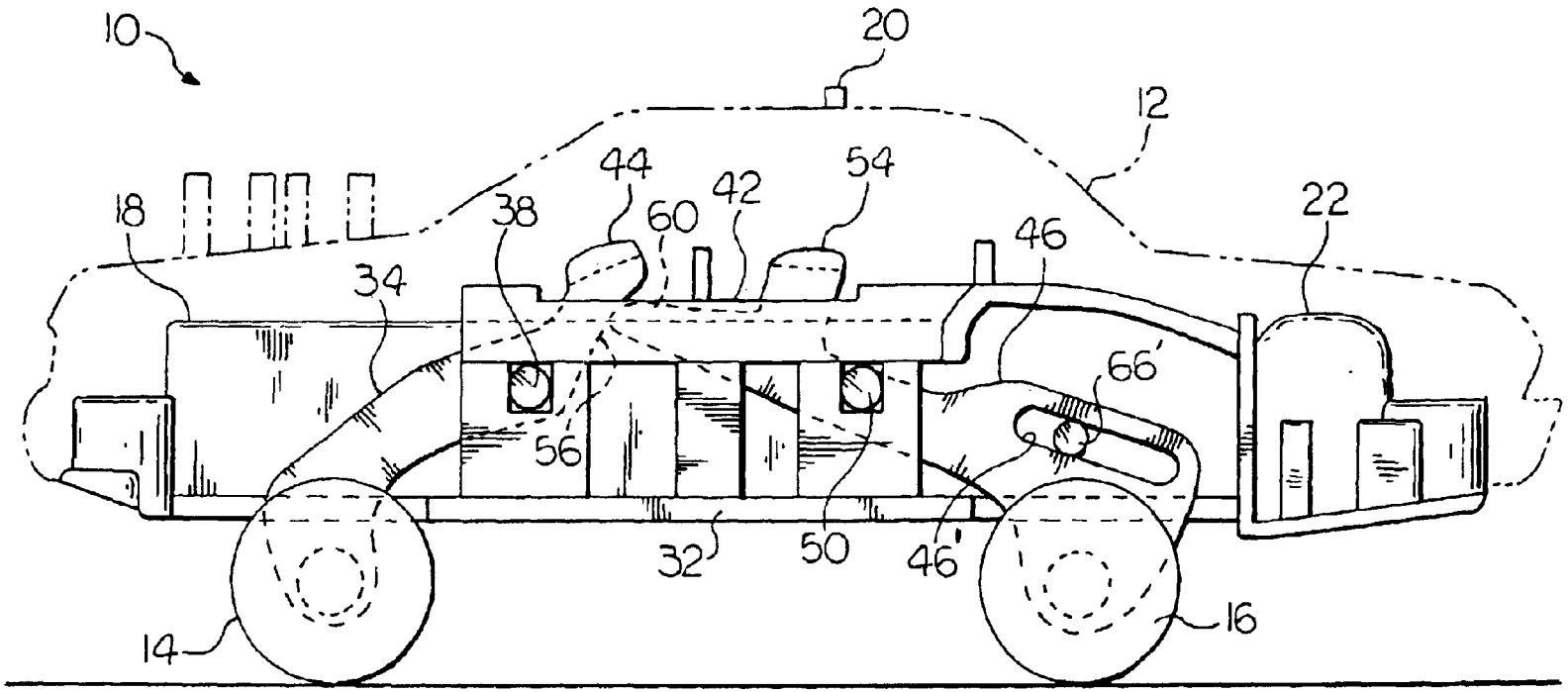
FIG. 2 is a side elevational view of the model car illustrated in FIG. 1 showing the chassis in the raised position.
Figure 3:
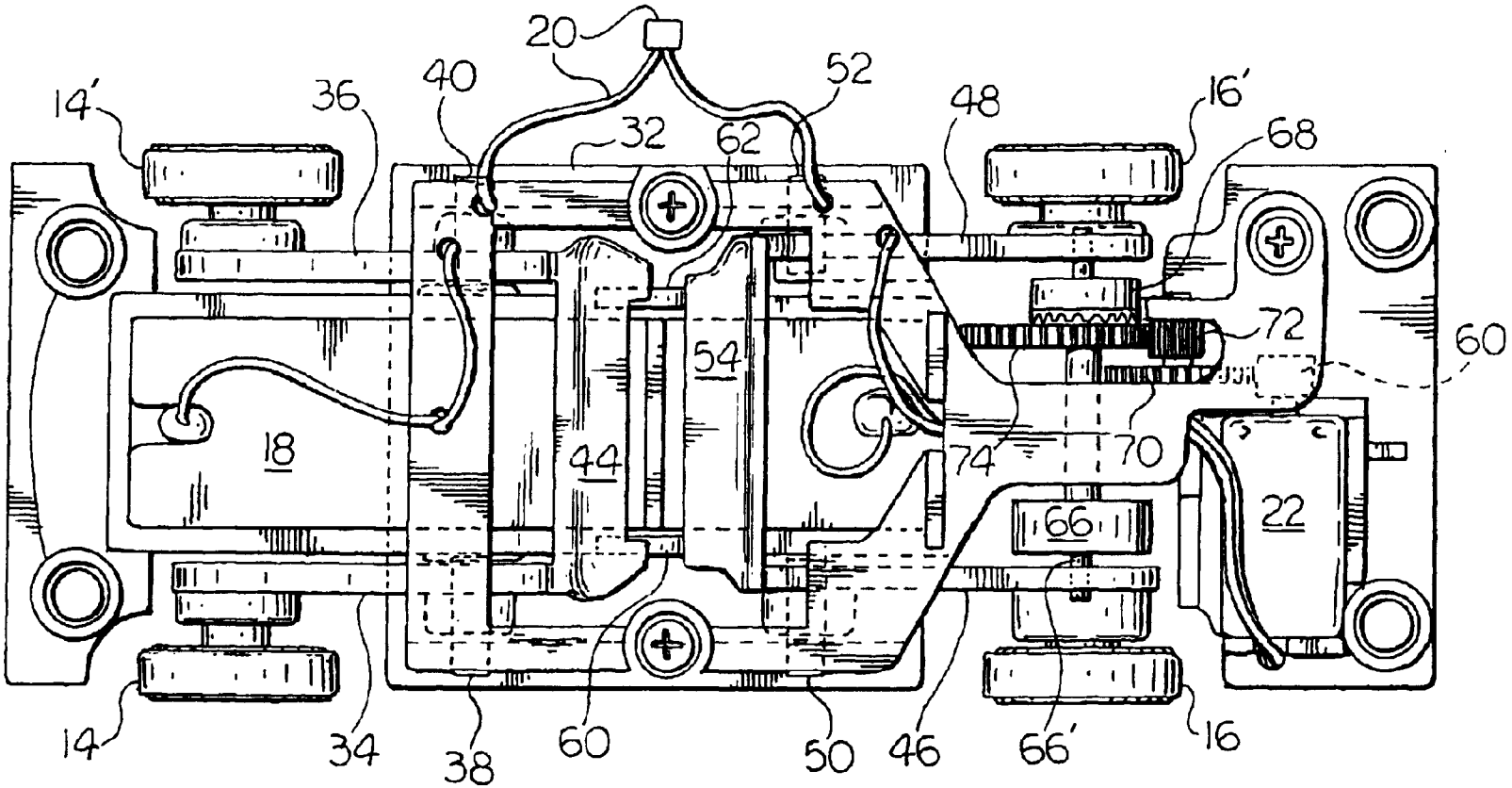
FIG. 3 is a top plan view of the model car illustrated in FIGS. 1 and 2 with the body portion removed.
Figure 4:
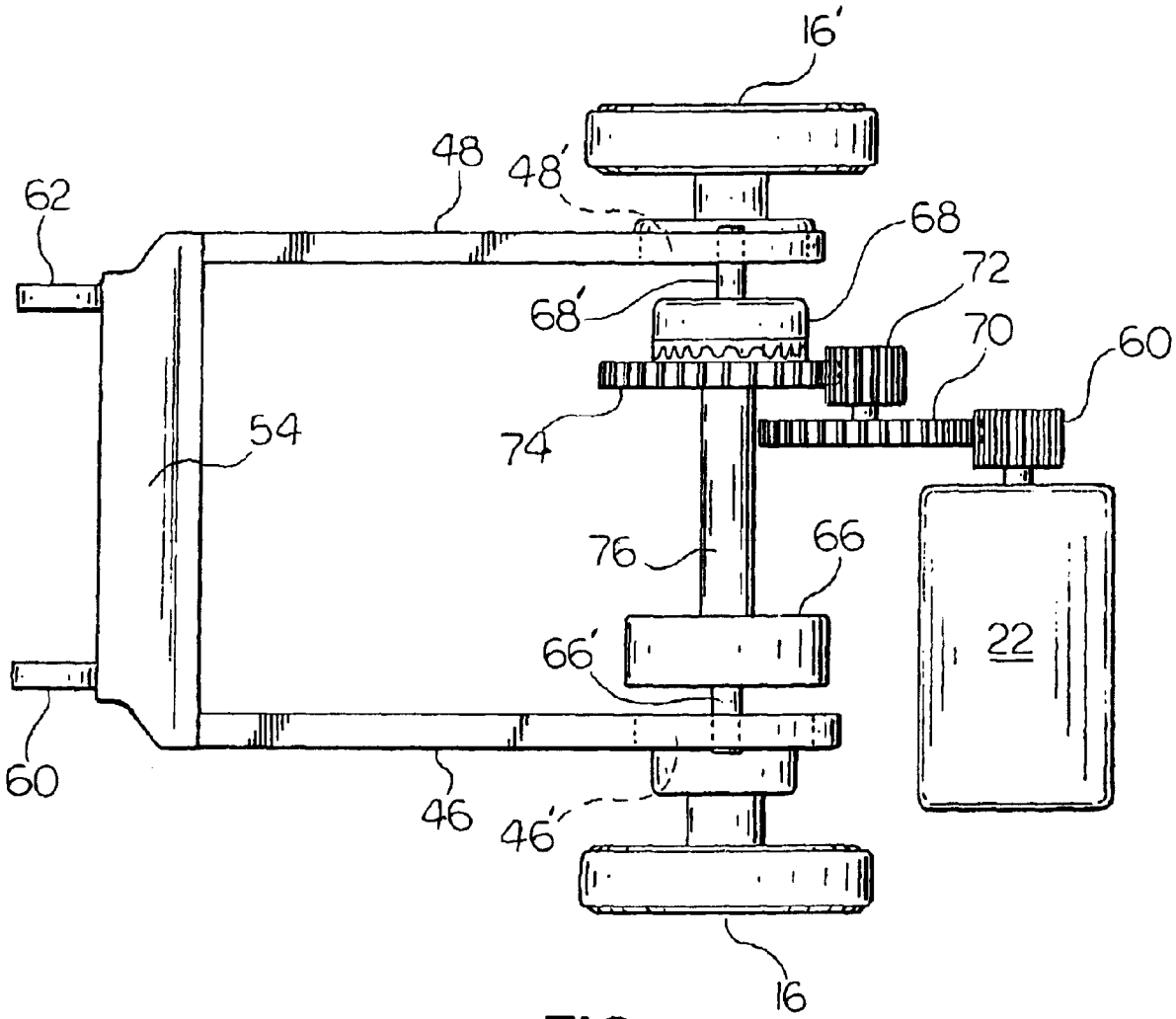
FIG. 4 is a fragmentary top plan view of the drive motor and gear train of the model car illustrated in FIGS. 1, 2 and 3.

Motion is transmitted through the gear train from a motor 22 to the cam arms 66' and 68' in the following manner. Initially, the motor 22 transmits rotary motion to the gear 64 which causes rotation of the gear 70 and the associated smaller gear 72. The gear 72 causes the gear 74 to rotate and simultaneously causes the axle shaft 76 and the associated cam wheels 66 and 68 to rotate. As the cam wheels 66 and 68 are caused to rotate, the associated cam arms 66' and 68' are caused to reciprocate within the slots 46' and 48' and produce up and down movement of the chassis 32 relative to the wheels 16 and 16'. Simultaneously with such movement of the wheels 16, 16', the downward pivotal movement of the outer ends of the arms 46 and 48 about their respective pivotal mountings 50 and 52, will cause the inner ends 60 and 62 of the arms 46 and 48 to pivot upwardly. The upward movement of the inner ends 60 and 62 causes the upper surfaces to contact the lower surfaces of the inner ends 56 and 58 of the arms 34 and 36 and cause the arms 34 and 36 to pivot about their respective pivot mountings 38 and 40. Such movement causes the outer ends and associated wheels 14 and 14' to move pivotally in respect of the chassis 32. As front wheels 14, 14' and the rear wheels 16, 16' are caused to move through respective arcs, the distance between the sets of wheels is varied from a lower position illustrated in FIG. 1 to an elevated of raised position as illustrated in FIG. 2. This up and down movement of the chassis 32 and the body 12 in respect of the wheels 14, 14' and 16, 16' continues so long as the motor 22 remains energized.

In accordance with the provisions of the patent statutes, the present invention has been described in what is considered to represent its preferred embodiment. However, it should be understood that the invention can be practiced otherwise than as specifically illustrated and described without departing from its spirit or scope.

What is claimed is:

1. A model car assembly comprising:

a chassis;

a first arm means having an inner end and an outer end, the outer end receiving ground engaging means;

a first pivotal mounting intermediate the inner and outer end of said first arm means for pivotally mounting said first arm means to said chassis;

second arm means having an inner end and an outer end, the outer end receiving ground engaging means, the inner end of said second arm means contactable with the inner end of said first arm means;

a second pivotal mounting intermediate the inner and outer end of said second arm means for pivotally mounting said second arm means to said chassis;

a drive motor;

a gear train coupling said motor to said first arm means to selectively move said first arm means about said first pivotal mounting causing the inner end thereof to move and simultaneously to cause the inner end of the second arm to move causing the respective arms and the respective ones of the ground engaging means to approach one another to cause said chassis to move upwardly.

2. The model car defined in claim 1 wherein the outer end of said first arm includes a longitudinally extending slot; and said gear train includes a cam arm mounted for vertical movement, said cam arm disposed within the slot of said first arm.

3. The model car defined in claim 1 wherein the outer end of said first arm includes a longitudinally extending slot; and said gear train includes a cam arm engageable within the slot in said first arm and means for imparting circular orbital movement to said cam arm to effect vertical pivotal movement of said first arm.

4. The model car defined in claim 3 wherein said first arm means includes a first pair of arms; and said first pivotal mounting includes a mounting for pivotally mounting an arm of said first pair of opposite sides of said chassis.

5. The model car defined in claim 4 wherein said second arm means includes a second pair of arms and said second pivotal mounting includes a mounting for pivotally mounting an arm of said second pair on opposite sides of said chassis in spaced relation from said first pivotal mounting.

6. The model car defined in claim 5 wherein said chassis includes a support.

7. The model car defined in claim 6 wherein the inner ends of said first pair of arms are coupled together by a first cross piece.

8. The model car defined in claim 7 wherein the inner ends of said second pair of arms are coupled together by a second cross piece.

9. The model car defined in claim 8 wherein said first and second cross pieces are adapted to rest on said support.

10. The model car defined in claim 1 wherein said first arm means is provided with an elongate slot, and said gear train includes a cam wheel having an extending cam arm receivable within the slot in said first arm means, whereby rotation of said cam wheel will cause said cam arm to slide within the slot and cause vertical movement of said chassis in respect of the ground engaging means of said first arm means and said second arm means.

11. A model car assembly comprising:

a chassis;

first set of arms having outer ends and inner ends, said arms receiving ground engaging means at the outer ends thereof;

a first pivotal mounting intermediate the outer and inner ends of said first set of arms for pivotally mounting said first set of arms to said chassis;

a second set of arms having outer and inner ends of said arms receiving ground engaging means at the outer ends thereof, and the inner ends of said second set of arms in sliding engagement with the inner ends of said first set of arms;

a second pivotal mounting intermediate the outer and inner ends of said second set of arms for pivotally mounting said second set of arms to said chassis;

a pivotal slip coupling for pivotally interconnecting the inner ends of said first set of arms and the inner ends of said second set of arms;

a drive motor;

a cam member engaging said first set of arms between the outer ends thereof and said first pivotal mounting;

a gear train coupled to said drive motor to drive said cam member to cause movement of said chassis upwardly and downwardly by causing pivotal movement of said first set of arms whereby the inner ends of said first set of arms cams the inner ends of said second set of arms upwardly causing an upward movement of said chassis.

* * * * *